US006276631B1

(12) United States Patent
Mio et al.

(10) Patent No.: US 6,276,631 B1
(45) Date of Patent: Aug. 21, 2001

(54) CHAIN-WINDING REEL

(75) Inventors: Katsuhiko Mio; Shigeo Kitagawa; Takashi Mitsufuji; Teruo Nakajima, all of Osaka (JP)

(73) Assignee: Tsubakimoto Chain Co., Osaka (JP)

( * ) Notice: Subject to any disclaimer, the term of this patent is extended or adjusted under 35 U.S.C. 154(b) by 0 days.

(21) Appl. No.: 09/628,365

(22) Filed: Jul. 31, 2000

(30) Foreign Application Priority Data

Jul. 30, 1999 (JP) ..... 11-217288

(51) Int. Cl.[7] ..... B65H 75/20
(52) U.S. Cl. ..... 242/604.1
(58) Field of Search ..... 242/604.1, 604, 242/118.4, 608.8, 609.4, 605; D8/358

(56) References Cited

U.S. PATENT DOCUMENTS

D. 197,393 * 1/1964 Beltram .
1,451,745 * 4/1923 Sommer .
1,799,343 * 4/1931 Williams .
1,862,199 * 6/1932 Schane .
2,080,355 * 5/1937 Geer .
2,973,915 * 3/1961 Elow .
3,503,569 * 3/1970 Gildart .
4,089,485 * 5/1978 Van de Loock .
4,570,871 * 2/1986 Compagnucci .
4,819,888 * 4/1989 Masera .
4,995,566 2/1991 Kotegawa et al. .
5,823,465 * 10/1998 Marangoni .

FOREIGN PATENT DOCUMENTS

40950-B * 6/1937 (NL) ..... 242/604.1

* cited by examiner

*Primary Examiner*—William A. Rivera
(74) *Attorney, Agent, or Firm*—Dann, Dorfman, Herrell and Skillman; Henry H. Skillman

(57) ABSTRACT

A winding reel which can be placed on another similar free winding reel so that they can be stored or carried in a comparatively small space and is convenient to carry or handle. The winding reel includes a hollow core section, and first and second flange sections provided at the opposite ends of the core section. The core section includes four core wire pieces extending in an axial direction thereof. The first flange section includes a first flange wire piece extending radially outwardly from a first end of each of the core wire pieces in a plane perpendicular to the axis and a connection wire piece for connecting outer ends of adjacent ones of the first flange wire pieces. The second flange section includes a second flange wire piece extending radially outwardly from a second end of each of the core wire pieces in a plane perpendicular to the axis and a third flange wire piece extending radially inwardly from the second end of each of the core wire pieces in the plane perpendicular to the axis. The third flange wire pieces are connected to each other at positions on the inner side of the core section and reinforce the second end of the core section.

2 Claims, 6 Drawing Sheets

CHAIN-WINDING REEL

BACKGROUND OF THE INVENTION

1. Field of the Invention

This invention relates to a chain-winding reel for storing and carrying a chain.

2. Description of the Related Art

Various chain-winding reels of the type mentioned are conventionally known, and one of such conventionally known winding reels is shown in FIG. 6. Referring to FIG. 6, the conventional winding reel shown is generally denoted at 50 and includes a pair of flange sections 52 and 54 and a core 56 extending between the flange sections 52 and 54. A plurality of bolts 58 extend through the core 56 between the flange sections 52 and 54 and fasten the flange sections 52 and 54 to the core 56.

Another conventionally known winding reel is shown in FIG. 7. Referring to FIG. 7, the conventional winding reel is generally denoted at 60 and includes a core section 62 and a pair of flange sections 64 formed by welding a plurality of suitably bent wire pieces or segments to each other.

Each of the winding reels 50 and 60 described above is utilized for storing and carrying a chain thereon with the chain wound on the core thereof. Further, the winding reels 50 and 60 are each used such that it is immersed into oil while a chain is wound on the core thereof in order to prevent corrosion of the chain. Besides, the winding reel 50 and 60 are produced as throw-away products and are in most cases abandoned after they are used by a fixed number of times.

The conventional winding reels have the following problems. Since the two flange sections have the same shape at the opposite ends of the core, a plurality of such winding reels cannot be stacked one on another, and where no chain is wound on such winding reels, they require a great space for storage and carrying. This problem similarly applies also when they are disassembled and abandoned after they are used. Even if a winding reel is disassembled in order to reduce the space into which it is to be abandoned, surplus operation is required for the disassembly. Further, even disassembly is impossible with the winding reel 60 of FIG. 7 which is formed from wire pieces welded to each other.

Further, when it is tried to immerse any of the conventional winding reels into oil with a chain wound on the core thereof in order to prevent corrosion, the winding reel has no portion which serves as a handle which can be grasped by a hand of the operator to handle the winding reel. Consequently, the conventional winding reels are disadvantageous in that they are low in workability and are not sufficiently high in safety when a heavy article is handled with them.

SUMMARY OF THE INVENTION

It is an object of the present invention to provide a winding reel which, when it is free or empty, can be placed on another similar free winding reel so that they can be stored or carried in a comparatively small space.

It is another object of the present invention to provide a winding reel which is convenient to carry or handle while it has a chain wound thereon.

In order to attain the objects described above, according to the present invention, there is provided a winding reel for a chain, comprising a hollow core section, and first and second flange sections provided at the opposite ends of the core section, the core section including three or more core wire pieces extending in an axial direction thereof, the first flange section including a first flange wire piece extending radially outwardly from a first end of each of the core wire pieces and a connection wire piece for connecting outer ends of adjacent ones of the first flange wire pieces on the outer side of the core section, the second flange section including a second flange wire piece extending radially outwardly from a second end of each of the core wire pieces and having an outer end positioned on the inner side of the connection wire piece and a third flange wire piece extending radially inwardly from the second end of each of the core wire pieces, the third flange wire pieces being connected to each other at positions on the inner side of the core section such that a shaft receiving hole is formed by the third flange wire pieces.

In particular, the winding reel of the present invention includes a hollow core section on which a chain is to be wound. In order to prevent a chain from getting out of shape when the chain is wound on the core section, a pair of flange sections are provided at the opposite ends of the core section. The core section is hollow such that a rotatable support shaft for supporting the winding reel for rotation thereon may be inserted in the core section. Since the third flange wire pieces are connected to each other at positions on the inner side of the core section such that a shaft receiving hole is formed by the third flange wire pieces, the rotatable support shaft may be inserted in the shaft receiving hole thus formed.

The flange sections include a first flange section and a second flange section. The first flange section includes a first flange wire piece extending radially outwardly from a first end of each of the core wire pieces. The first flange wire pieces prevent a chain wound on the core section from getting out of shape to the first end side of the core section. In order that the first flange section may keep a required strength, outer ends of adjacent ones of the first flange wire pieces are connected to each other by a connection wire piece. The second flange section includes a second flange wire piece extending radially outwardly from a second end of each of the core wire pieces. The second flange wire pieces prevent a chain wound on the core section from getting out of shape to the second end side of the core section. The second flange section further includes a third flange wire piece extending radially inwardly from the second end of each of the core wire pieces. Adjacent ones of the third flange wire pieces are connected to each other in order that the second flange section may keep a required strength.

In order to allow the winding reel to be stacked on another similar winding reel, the outer ends of the second flange wire pieces of the second flange section are positioned on the radially inner side of the connection wire pieces of the first flange section. If a first one of such winding reels is placed on the floor such that the first flange section thereof contacts with the floor and then a second one of the winding reels is operated so as to be stacked on the first winding reel such that it is displaced in an angular phase around the axis of the core section, then the connection wire piece of the first flange section of the second winding reel passes the second flange wire pieces of the first winding reel without interfering with the same until the second winding reel is stacked onto the first winding reel.

In the second flange section, the third flange wire pieces extend radially inwardly from the second ends of the core wire pieces and are connected to each other. Consequently, by displacing the angular phases of the first and second winding reels from each other, they can be stacked one on the other without interference of the core sections of them with each other. The winding reels stacked in this manner contact at the third flange sections thereof with each other. Consequently, the second winding reel stacked on the first winding reel assumes an additional space which has a magnitude equal to the thickness of the wire pieces both in the axial direction and the circumferential direction. Consequently, a great number of such winding reels can be stored and carried with a much smaller stack space than that where they alternatively assume their individually independent spaces.

With the winding reel, while a chain-winding function and a function of preventing a chain from getting out of shape are maintained, a plurality of such winding reels in a free or no-load state can be stacked readily one on another for storage or carrying. In particular, since the winding reel is formed such that the first flange section formed at the first end of the core section can pass the second flange section of another similar winding reel as described above, a plurality of free or empty winding reels can be stacked successively on the winding reel. Consequently, the storage space or carrying space for the winding reels can be reduced to achieve efficient utilization of the working site. Further, where the winding reel is produced as a throwaway-winding reel, also the space of a place in which such abandoned winding reels is stored can be reduced simultaneously.

Preferably, the second flange section further includes a fourth flange wire piece extending radially outwardly from a portion of each of the core wire pieces spaced in the axial direction from the second end of the core wire piece and shorter than the first flange wire pieces, and the second flange wire pieces and the fourth flange wire pieces are connected to each other to form grips for facilitating handling of the winding reel. The structure just described augments convenience in carrying and handling.

Whichever ones of the second flange wire pieces and the fourth flange wire pieces may be positioned on the outside in the axial direction. With the winding reel, loop-shaped grips are formed at the second end side of the core section. Thus, the winding reel on which a chain is wound can be lifted readily making use of the grips which do not interfere with the chain. Consequently, an operation of immersing the winding reel into oil for corrosion prevention can be performed efficiently.

With the winding reel, since the grips which do not interfere with a chain wound on the core section is provided at the second end of the core section, handling of the chain when the winding reel is immersed into oil for corrosion prevention is facilitated, and the winding reel can be handled with safety.

The above and other objects, features and advantages of the present invention will become apparent from the following description and the appended claims, taken in conjunction with the accompanying drawings in which like parts or elements denoted by like reference symbols.

DESCRIPTION OF THE PREFERRED EMBODIMENT

Figure 1:
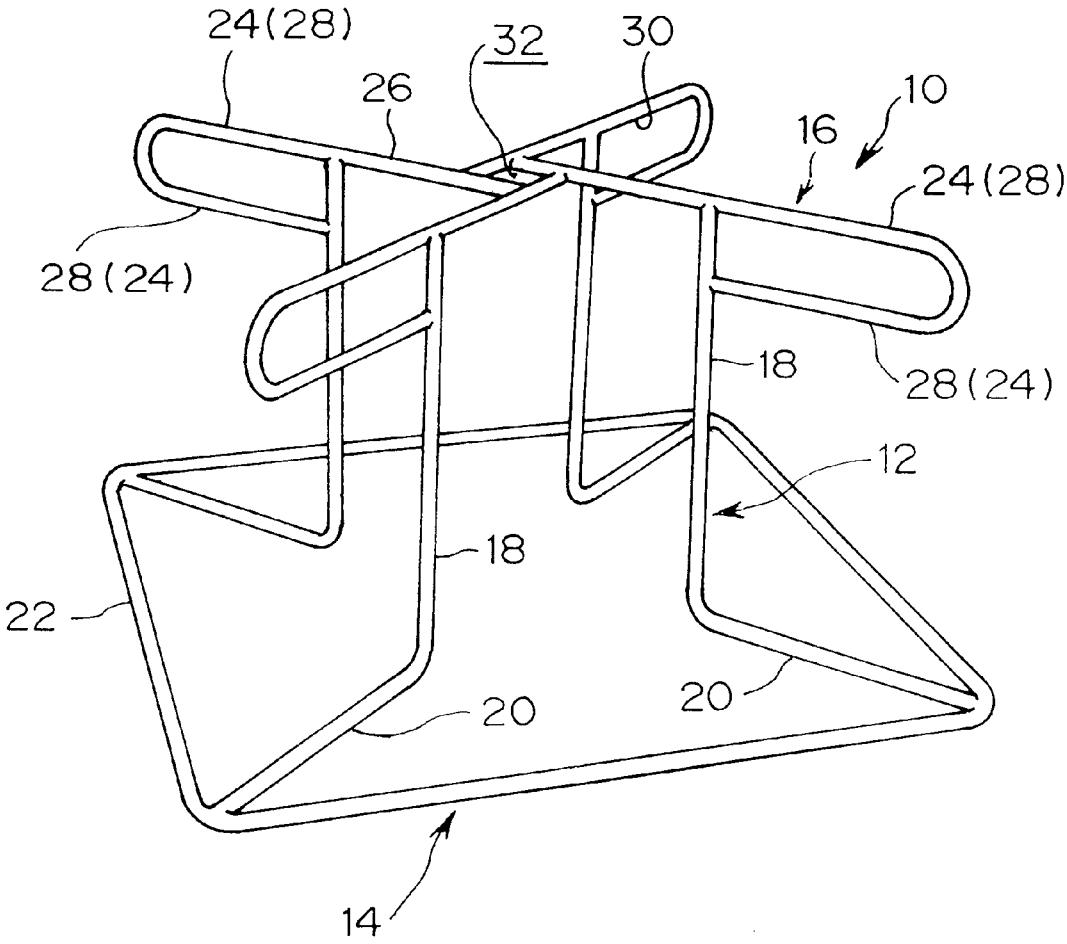
FIG. 1 is a perspective view of a winding reel to which the present invention is applied.
Figure 2:
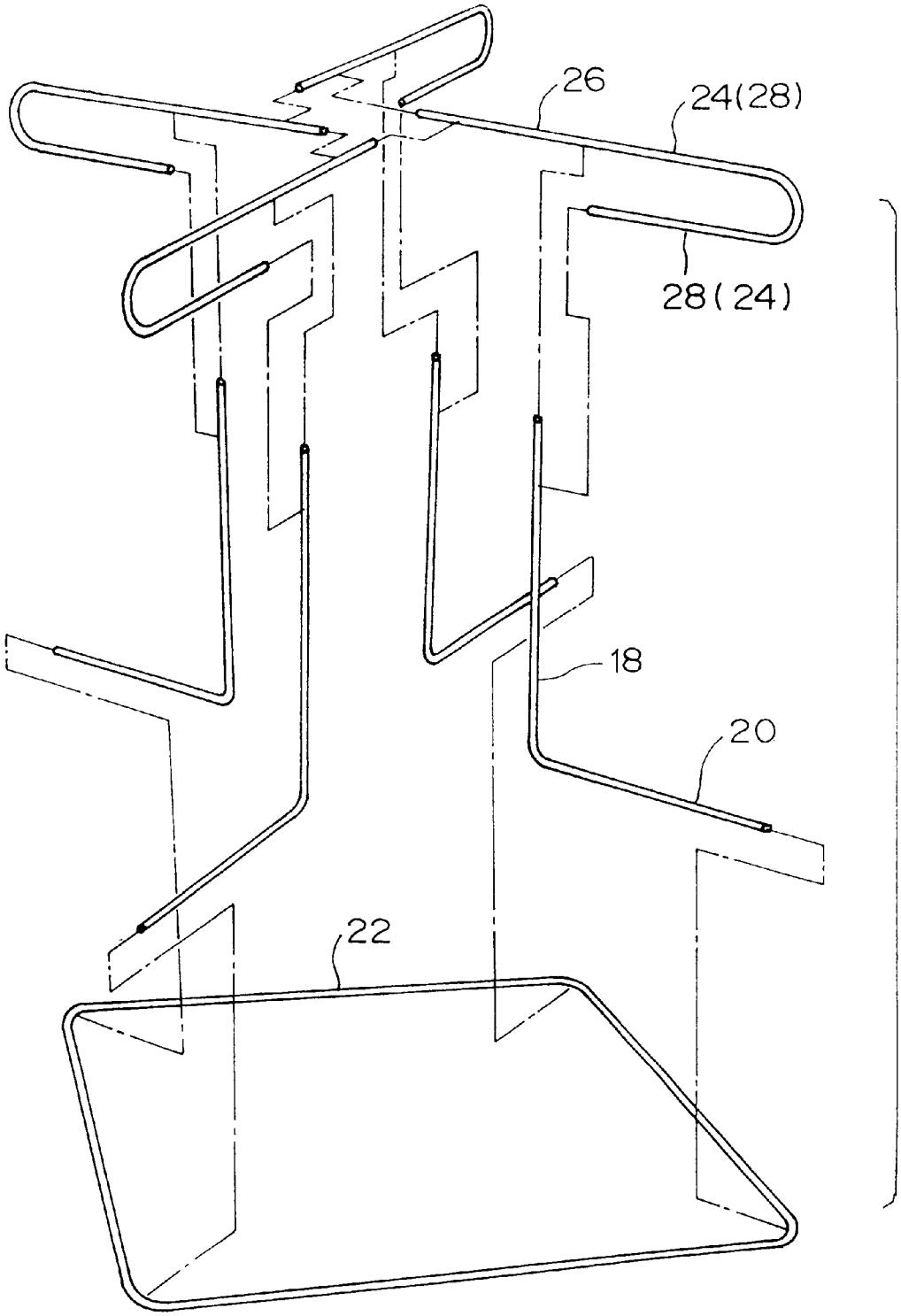
FIG. 2 is an exploded perspective view of the winding reel of FIG. 1.
Figure 3:
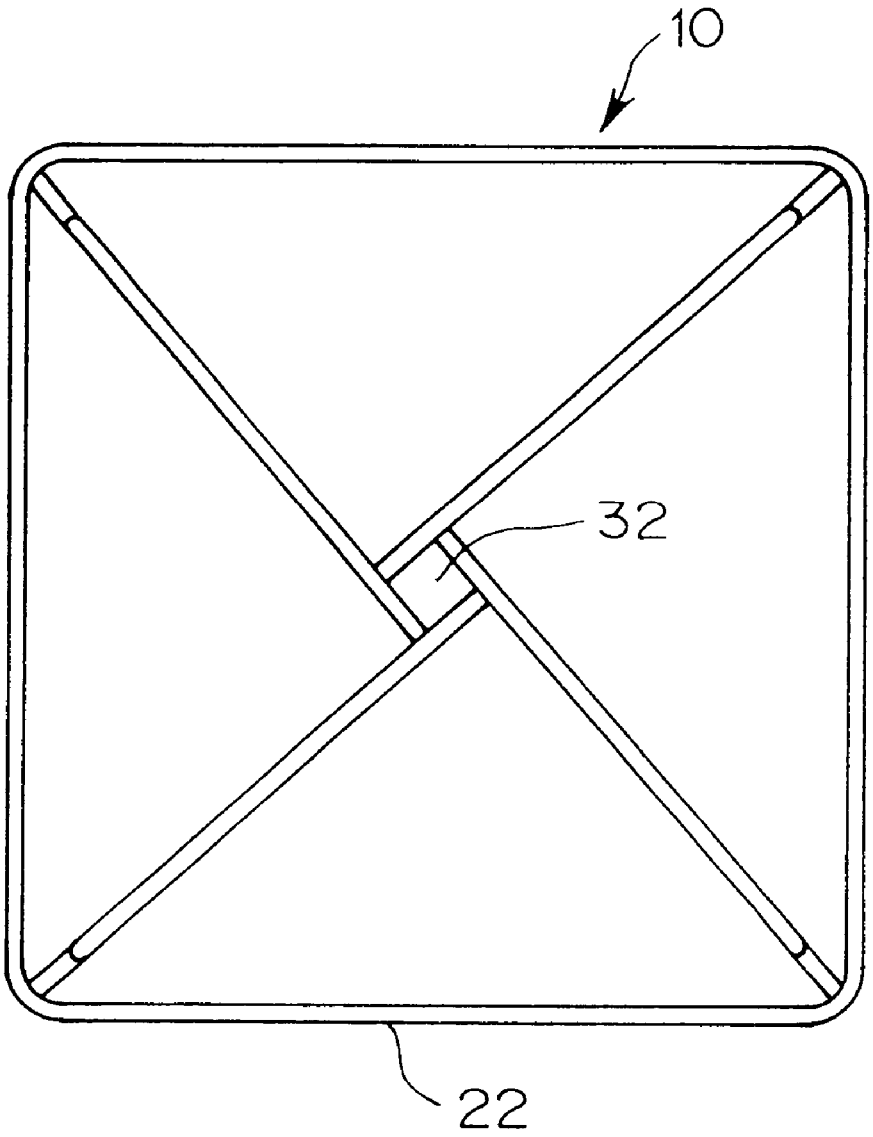
FIG. 3 is a top plan view of the winding reel of FIG. 1.

Referring to FIGS. 1 to 3, there is shown a winding reel to which the present invention is applied. The winding reel shown is generally denoted at 10 and includes a core section 12 and first and second flange sections 14 and 16 formed at the opposite ends of the core section 12. The core section 12 includes four core wire pieces 18 extending substantially in an axial direction and in parallel to each other and is formed hollow. The core section 12 is a portion around which a chain is to be wound. Therefore, the core wire pieces 18 may be inclined a little such that they extend along generators of a cone. While the number of the wire pieces 18 of the winding reel 10 in the present embodiment is four, it must be at least three and may be any number equal to or greater than three.

The first flange section 14 is formed at one axial end of the core section 12, and the second flange section 16 is formed at the other axial end of the core section 12. The flange sections 14 and 16 prevent a chain wound on the core section 12 from getting out of shape. The first and second flange sections 14 and 16 have structures different from each other. The different structures of the first and second flange sections 14 and 16 allow a plurality of such winding reels 10 to be stacked one on another.

The first flange section 14 is formed from four first flange wire pieces 20 each extending radially outwardly from a first end, that is, the lower end in FIG. 1, of each of the core wire pieces 18 in a plane perpendicular to the axis, and a connection wire piece 22 for connecting outer ends of the first flange wire pieces 20 to each other.

Each of the first flange wire pieces 20 radially extends in an offset relationship from the center of the core 12 as seen in FIG. 3. Consequently, a required space when such winding reels 10 are stacked is reduced as hereinafter described.

The connection wire piece 22 is formed so as to interconnect neighboring ones of the first flange wire pieces 20 principally in order that it may serve as a reinforcing part for the first flange wire pieces 20. The connection wire piece 22 in the embodiment is square in shape corresponding to the number of the core wire pieces 18. The strength of the first flange section 14 is increased by connecting the first flange wire pieces 20 to the corners of the connection wire piece 22. It is to be noted that the connection wire piece 22 may be formed in a circular shape such that the ends of the first flange wire pieces 20 are connected in an inscribed relationship to the circular connection wire piece 22. The reason why the ends of the first flange wire pieces 20 are connected to the connection wire piece 22 is that it is intended to eliminate any protrusion of the first flange wire pieces 20 from the winding reel 10 to secure the safety in working.

The second flange section 16 includes second flange wire pieces 24 extending radially outwardly from the other or second ends, that is, the upper ends in FIG. 1, of the core wire pieces 18 in a plane perpendicular to the axis and third flange wire pieces 26 extending radially inwardly from the second ends of the core wire pieces 18 in a plane perpendicular to the axis. In the winding reel 10 of the present embodiment, the second flange section 16 further includes fourth flange wire pieces 28 extending radially outwardly in a plane perpendicular to the axis from portions the core wire pieces 18 spaced from the second ends. The second flange wire pieces 24, the third flange wire pieces 26 and the fourth flange wire pieces 28 extend in the same phase as the first flange wire pieces 20 around the axis and radially extend in an offset relationship from the center of the core section 12. Consequently, a required space when such winding reels 10 are stacked is reduced as hereinafter described.

The second flange wire pieces 24 or the fourth flange wire pieces 28 prevent a chain wound on the core section 12 from getting out of shape. The second flange wire pieces 24 and the fourth flange wire pieces 28 are connected arcuately at radially outer ends thereof to each other to form grips 30 for the winding reel 10. The reason why the ends of the second and fourth flange wires 24 and 28 are connected arcuately is that it is intended to secure the safety in working.

The third flange wire pieces 26 are connected to each other at radially inner portions thereof than the core section 12 and reinforce the second end of the core section 12. Since the third flange wire pieces 26 are offset from the center of the core section 12, where the third flange wire pieces 26 are connected to each other, a shaft receiving hole 32 is formed by them as particularly seen in FIG. 3. In the winding reel 10 of the present embodiment, the shaft receiving hole 32 has a square shape because the winding reel 10 uses four third flange wire pieces 26.

The winding reel 10 is formed by cutting, bending and welding three kinds of wire pieces or segments. As shown in FIG. 2, the first kind of wire segment is a wire segment which is bent in a square shape and welded at confronting ends thereof, and the connection wire piece 22 is formed from a wire segment of the first kind. The second kind of wire segment is a wire segment bent in an L-shape, and the core wire pieces 18 and the first flange wire pieces 20 are formed from wire segments of the second kind. The third kind of wire segment is a wire segment bent in a J-shape, and the second wire pieces 24, the third wire pieces 26, and the fourth flange wire pieces 28 are formed from wire segments of the third kind. Then, the winding reel 10 is formed by fixing the first, second, and third wire segments suitably to a jig and welding them.

Figure 4:
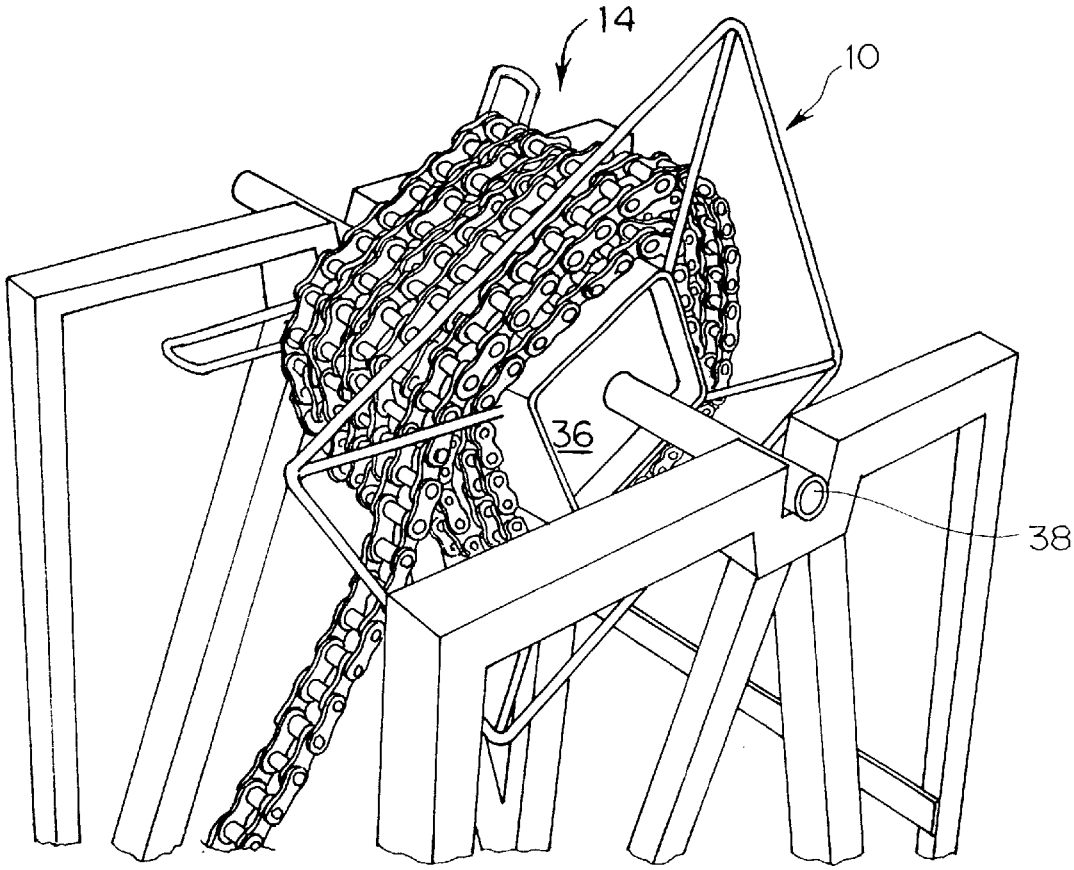
FIG. 4 is a perspective view of the winding reel of FIG. 1 on which a chain is wound.

FIG. 4 shows the winding reel 10 on which a chain is wound. Referring to FIG. 4, the winding reel 10 is supported for rotation by means of a rotatable support shaft 38 to which a hub member 36 of the winding reel 10 is attached, and the chain is unwound stepwise by a predetermined length from the winding reel 10. The hub member has a shape complementary to the hollow of the core section 12. In the winding reel 10 of the present embodiment, the hub member has a profile of a square pole having a shaft-receiving hole formed therein. The support shaft 38 is fitted in the shaft-receiving hole of the hub member.

Alternatively, the winding reel 10 may be placed on a horizontally rotatable disk member having a projection formed at the center thereof for fitting with the shaft receiving hole 32 such that a chain is unwound stepwise by a predetermined length from the winding reel 10 while rotating the disk member.

Figure 5:
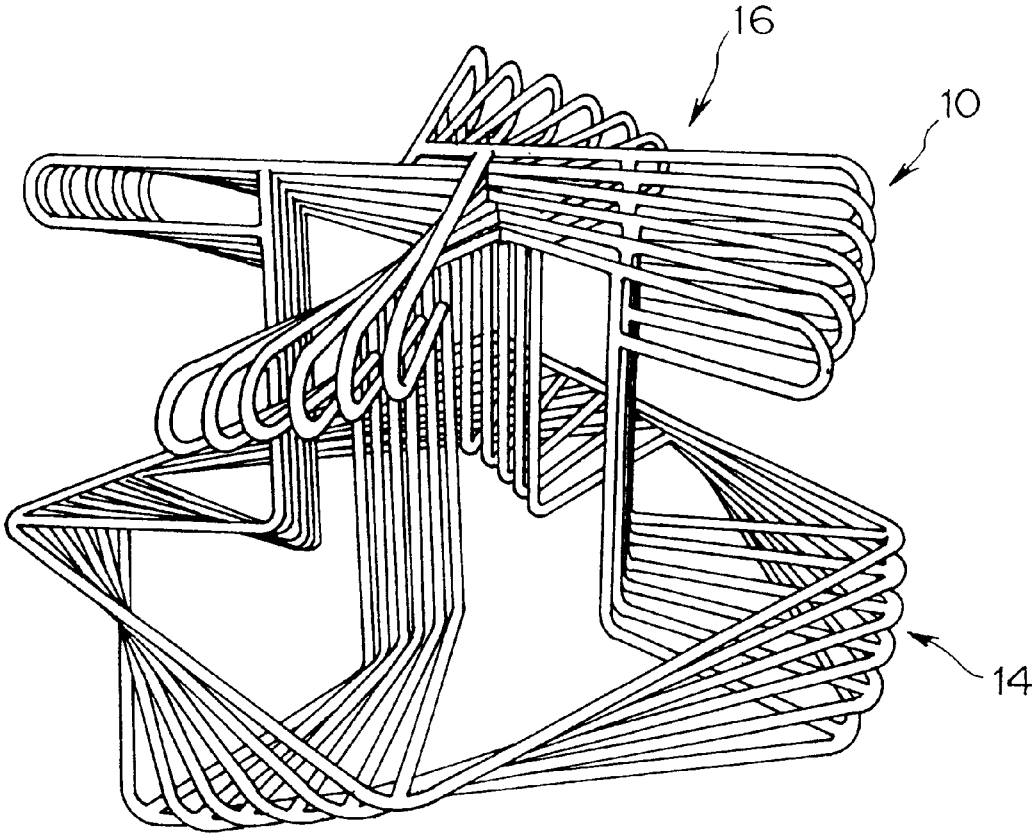
FIG. 5 is a perspective view of a plurality of winding reels of FIG. 1 stacked on each other.
Figure 6:
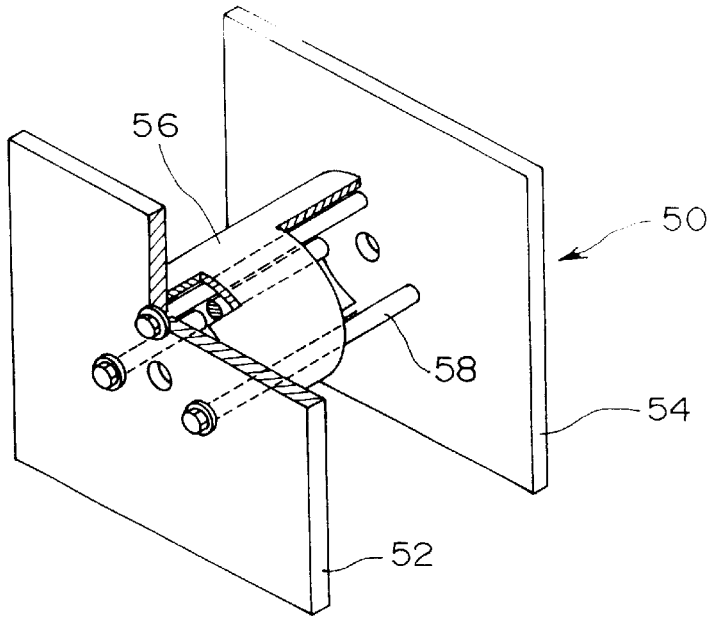
FIG. 6 (Prior Art)
FIG. 6 is a perspective view of a conventional winding reel.
Figure 7:
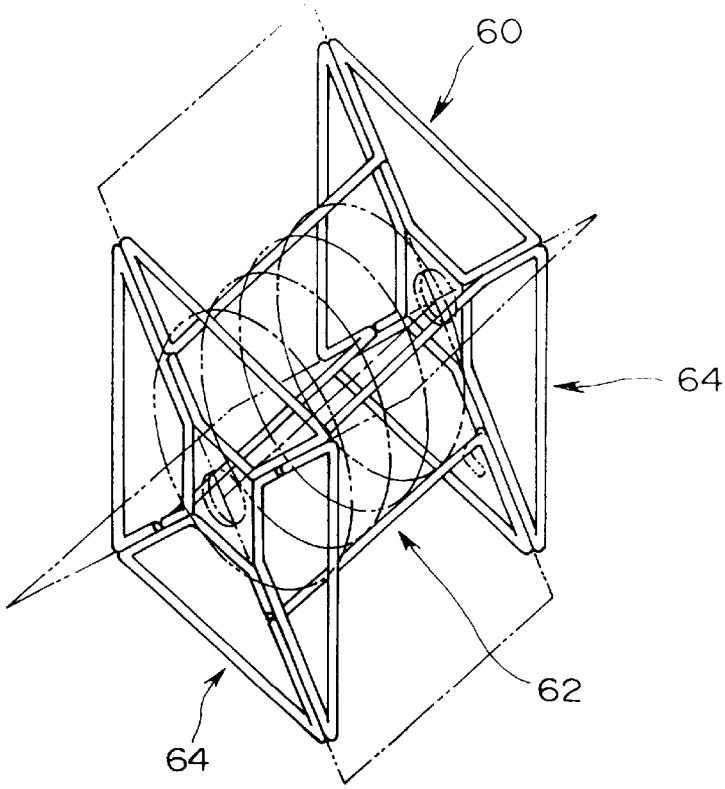
FIG. 7 (Prior Art)
FIG. 7 is a perspective view of another conventional winding reel.

FIG. 5 shows a plurality of winding reels 10 stacked on each other. In the winding reel 10 of the present embodiment, at the corner portions of the connection wire piece 22, the outer ends of the second flange wire pieces 24 and the fourth flange wire pieces 26 are positioned on the radially inner side than the connection wire piece 22 of the first flange section 14. Consequently, the connection wire piece 22 of a first winding reel 10 to be placed on a second winding reel 10 can pass the second flange section 16 of the second winding reel 10. Accordingly, different winding reels can be stacked on each other while preventing a chain from getting out of shape in the opposite directions.

Further, all of the core wire pieces 18, first flange wire pieces 20, second flange wire pieces 24, third flange wire pieces 26 and fourth flange wire pieces 28 are offset from the center of the core section 12 and extend in the same directions while the third flange wire pieces 26 of the second flange section 16 are connected to each other at portions thereof radially inner than the core section 12. Consequently, a plurality of winding reels 10 can be stacked successively in a small space by disposing them in a displaced relationship from each other by an angular phase corresponding to the thickness of the wire segments as seen in FIG. 5.

While a preferred embodiment of the present invention has been described using specific terms, such description is for illustrative purposes only, and it is to be understood that changes and variations may be made without departing from the spirit or scope of the following claims.

What is claimed is:

1. A winding reel for a chain, comprising:

a hollow core section; and first and second flange sections provided at the opposite ends of said core section;

said core section including three or more core wire pieces extending in an axial direction thereof;

said first flange section including a first flange wire piece extending radially outwardly from a first end of each of said core wire pieces and a connection wire piece for connecting outer ends of adjacent ones of the first flange wire pieces on the outer side of said core section;

said second flange section including a second flange wire piece extending radially outwardly from a second end of each of said core wire pieces and having an outer end positioned on the inner side of said connection wire piece and a third flange wire piece extending radially inwardly from the second end of each of said core wire pieces, the third flange wire pieces being connected to each other at positions on the inner side of said core section such that a shaft receiving hole is formed by said third flange wire pieces.

2. A winding real for a chain as claimed in claim 1, wherein said second flange section further includes a fourth flange wire piece extending radially outwardly from a portion of each of said core wire pieces spaced in the axial direction from the second end of the core wire piece and shorter than said first flange wire pieces, and the second flange wire pieces and the fourth flange wire pieces are connected to each other to form grips for facilitating handling of said winding reel.

* * * * *